US006311589B1

(12) United States Patent
Schmitt

(10) Patent No.: US 6,311,589 B1
(45) Date of Patent: Nov. 6, 2001

(54) LOCKING PLIERS

(76) Inventor: Carlan Schmitt, 1862 Glen Ter., Saint Paul, MN (US) 55116

( * ) Notice: Subject to any disclaimer, the term of this patent is extended or adjusted under 35 U.S.C. 154(b) by 0 days.

(21) Appl. No.: 09/288,115

(22) Filed: Apr. 8, 1999

(51) Int. Cl.[7] ..... B25B 7/02
(52) U.S. Cl. ..... 81/426; 269/902
(58) Field of Search ..... 81/426, 426.5, 81/424.5, 424, 352, 353, 354; 269/3, 6, 902; D8/52, 54, 55

(56) References Cited

U.S. PATENT DOCUMENTS

D. 297,103 * 8/1988 Parish, Sr. ..... D8/52
3,383,963 * 5/1968 Vondrachek ..... 81/423
3,964,352 * 6/1976 Dukes ..... 81/426
4,559,853 * 12/1985 Oye ..... 81/420
4,982,631 * 1/1991 Lowther ..... 81/426
5,282,302 * 2/1994 Starks et al. ..... 29/268
5,537,727 * 7/1996 Mayer ..... 29/237

* cited by examiner

*Primary Examiner*—Stephen F. Gerrity
*Assistant Examiner*—Hadi Shakeri

(57) ABSTRACT

A locking pliers for holding cylindrical elongate objects such as rods and tubing to a work surface. The locking pliers includes a pair of jaws pivotally coupled together. Each of the jaws has a jaw plate coupled thereto. A generally V-shaped clamping plate is coupled to a first of the jaw plates. An elongate bar is coupled to a second of the jaw plates.

10 Claims, 2 Drawing Sheets

LOCKING PLIERS

BACKGROUND OF THE INVENTION

1. Field of the Invention

The present invention relates to locking or vise grip pliers and hand tools and more particularly pertains to a new locking pliers for holding cylindrical elongate objects such as rods and tubing to a work surface.

2. Description of the Prior Art

The use of locking or vise grip pliers and hand tools is known in the prior art. More specifically, locking or vise grip pliers and hand tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,808,870 by Blancett; U.S. Pat. No. 3,383,963 by Vondrachek; U.S. Pat. No. 4,290,591 by Smith; U.S. Pat. No. 2,725,774 by Tekse; U.S. Pat. No. Des. 250,451 by Chartier et al.; and U.S. Pat. No. 5,052,251 by Mills.

While these devices fulfill their respective, particular objectives and requirements, the aforementioned patents do not disclose a new locking pliers. The inventive device includes a pair of jaws pivotally coupled together. Each of the jaws has a jaw plate coupled thereto. A generally V-shaped clamping plate is coupled to a first of the jaw plates. An elongate bar is coupled to a second of the jaw plates.

In these respects, the locking pliers according to the present invention substantially departs from the conventional concepts and designs of the prior art, and in so doing provides an apparatus primarily developed for the purpose of holding cylindrical elongate objects such as rods and tubing to a work surface.

SUMMARY OF THE INVENTION

In view of the foregoing disadvantages inherent in the known types of locking or vise grip pliers and hand tools now present in the prior art, the present invention provides a new locking pliers construction wherein the same can be utilized for holding cylindrical elongate objects such as rods and tubing to a work surface.

The general purpose of the present invention, which will be described subsequently in greater detail, is to provide a new locking pliers apparatus and method which has many of the advantages of the locking or vise grip pliers and hand tools mentioned heretofore and many novel features that result in a new locking pliers which is not anticipated, rendered obvious, suggested, or even implied by any of the prior art locking or vise grip pliers and hand tools, either alone or in any combination thereof.

To attain this, the present invention generally comprises a pair of jaws pivotally coupled together. Each of the jaws has a jaw plate coupled thereto. A generally V-shaped clamping plate is coupled to a first of the jaw plates. An elongate bar is coupled to a second of the jaw plates.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new locking pliers apparatus and method which has many of the advantages of the locking or vise grip pliers and hand tools mentioned heretofore and many novel features that result in a new locking pliers which is not anticipated, rendered obvious, suggested, or even implied by any of the prior art locking or vise grip pliers and hand tools, either alone or in any combination thereof.

It is another object of the present invention to provide a new locking pliers which may be easily and efficiently manufactured and marketed.

It is a further object of the present invention to provide a new locking pliers which is of a durable and reliable construction.

An even further object of the present invention is to provide a new locking pliers which is susceptible of a low cost of manufacture with regard to both materials and labor, and which accordingly is then susceptible of low prices of sale to the consuming public, thereby making such locking pliers economically available to the buying public.

Still yet another object of the present invention is to provide a new locking pliers which provides in the apparatuses and methods of the prior art some of the advantages thereof, while simultaneously overcoming some of the disadvantages normally associated therewith.

Still another object of the present invention is to provide a new locking pliers for holding cylindrical elongate objects such as rods and tubing to a work surface.

Yet another object of the present invention is to provide a new locking pliers which includes a pair of jaws pivotally coupled together. Each of the jaws has a jaw plate coupled thereto. A generally V-shaped clamping plate is coupled to a first of the jaw plates. An elongate bar is coupled to a second of the jaw plates.

Still yet another object of the present invention is to provide a new locking pliers that lets a user hold a cylindrical elongate object to a flat surface without the object rolling on the surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
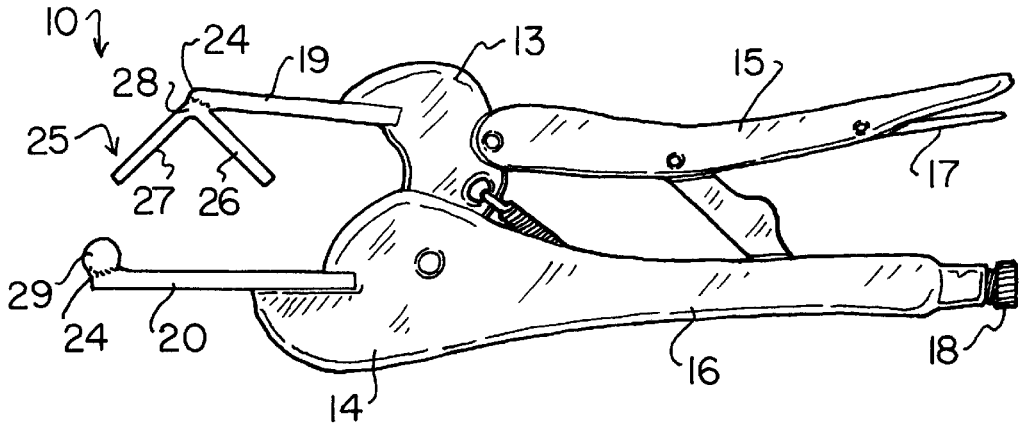
FIG. 1 is a schematic side view of a new locking pliers according to the present invention.
Figure 2:
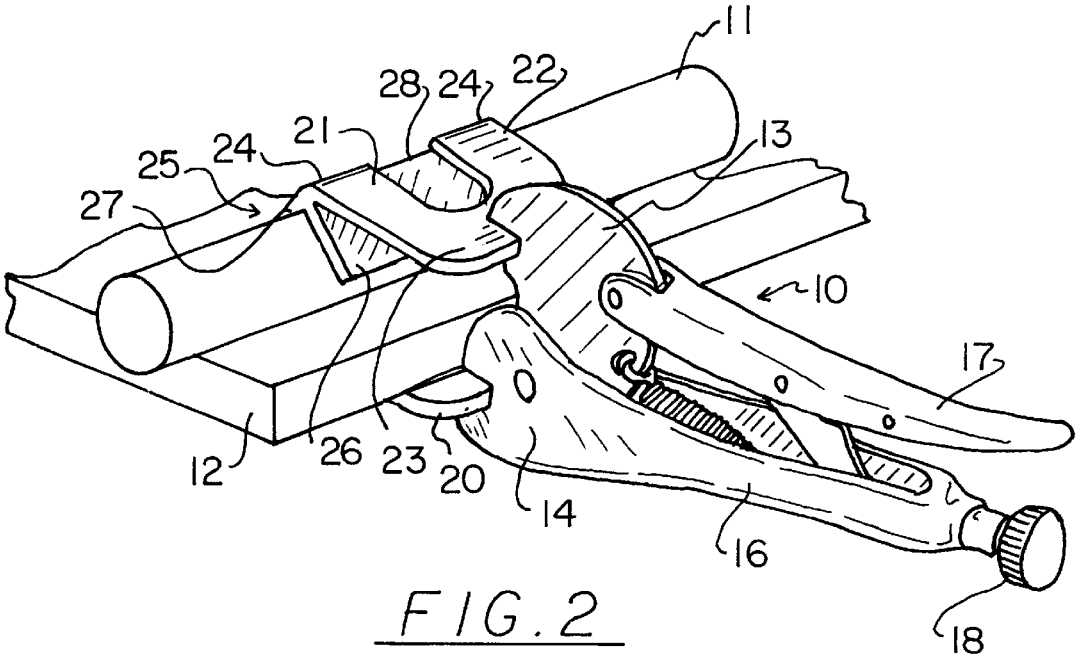
FIG. 2 is a schematic perspective view of the present invention in use holding an object to a support surface.
Figure 3:
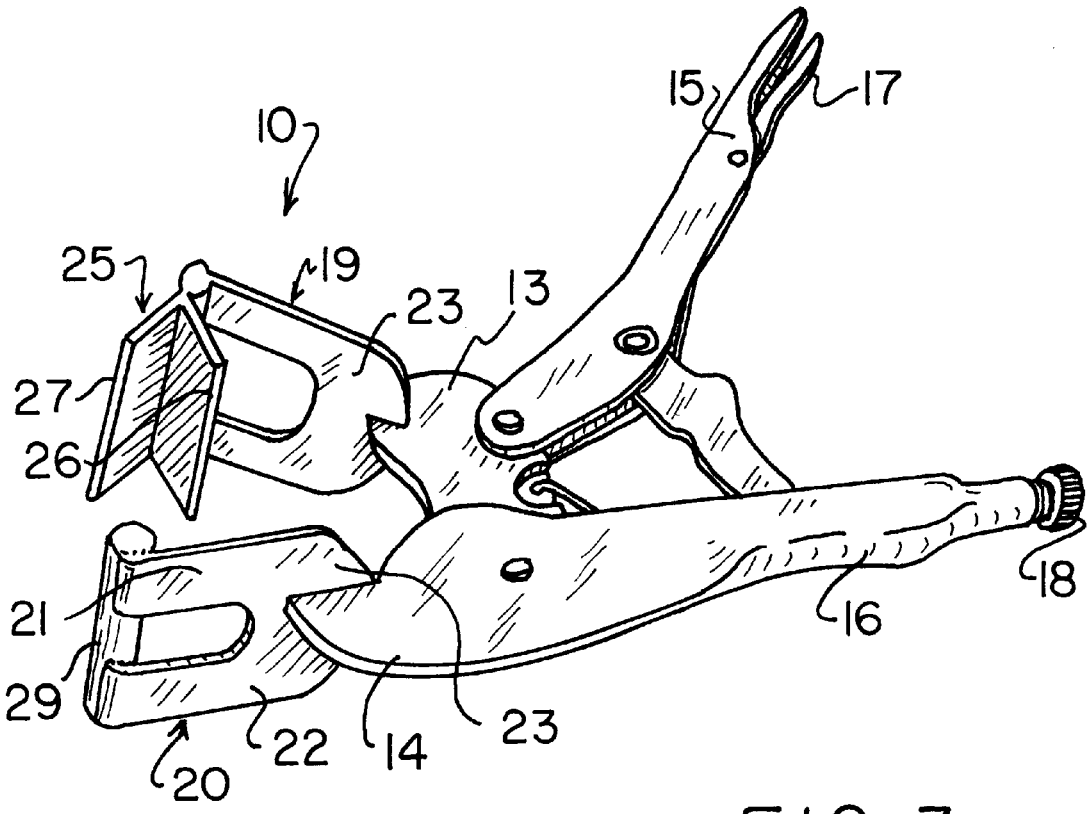
FIG. 3 is a schematic perspective view of the present invention.

With reference now to the drawings, and in particular to FIGS. 1 through 3 thereof, a new locking pliers embodying the principles and concepts of the present invention and generally designated by the reference numeral 10 will be described.

As best illustrated in FIGS. 1 through 3, the locking pliers 10 generally comprises a pair of jaws pivotally coupled together. Each of the jaws has a jaw plate coupled thereto. A generally V-shaped clamping plate is coupled to a first of the jaw plates. An elongate bar is coupled to a second of the jaw plates.

In use, the locking pliers 10 is a hand tool for holding a cylindrical elongate object 11 such as an elongate rod or an elongate tube to a flat support surface 12 such as a tabletop or a flat step of a ladder as illustrated in FIG. 2. In closer detail, the locking pliers comprises a pair of jaws 13,14 pivotally coupled together. A pair of handles 15,16 are connected to the jaws to permit corresponding pivoting of the jaws with relative movement of the handles towards and apart from each other. A locking mechanism is provided for releasably holding the jaws in a fixed position with respect to one another. The locking mechanism has a release lever 17 mounted to one of the handles whereby actuation of the release lever disengages the locking mechanism from holding the jaws to release the jaws from the fixed position. An adjustment mechanism is also provided for adjusting the spacing between the jaws. The adjustment mechanism has an adjustment screw 18 rotatably mounted to one of the handles whereby rotation of the adjustment screw in a first direction decreases the spacing between the jaws and rotation of the adjustment screw in a second direction opposite the first direction increases the spacing between the jaws.

Each of the jaws has a jaw 19,20 plate coupled thereto. Each of the jaw plates is preferably generally U-shaped and has a pair of spaced apart generally straight arms 21,22 and an arcuate middle portion 23 connecting the arms of the respective jaw plate together. Each of the jaws is coupled to the associated jaw plate at the middle portion of the associated jaw plate such that the arm portions of each jaw plate outwardly extend from the respective jaw. Each of the arms of each jaw plate has a free end 24 opposite the middle portion of the respective jaw plate.

A generally V-shaped clamping plate 25 is coupled to a first of the jaw plates. The clamping plate has a pair of substantially planar side portions 26,27 converging together to form a vertex spine 28 therebetween. The vertex spine of the clamping plate is preferably coupled to the free ends of the arms of the first jaw plate to couple the clamping plate to the first jaw plate.

The side portions of the clamping plate include an inner side portion 26 and an outer side portion 27. The inner side portion of the clamping plate is extended in a direction has a vector extending towards the jaw coupled to the first jaw plate. The outer side portion of the clamping plate is extended in a direction has a vector extending outwardly away from the jaw coupled to the first jaw plate.

Preferably, the side portions of the clamping plate lie in planes forming an angle less than about 180 degrees therebetween. Ideally, the angle formed between the side portions of the clamping plate is about 90 degrees. Preferably, at least one of the side portions of the clamping plate lie in a plane extending at an acute angle to the plane in which the first jaw plate lies. Ideally, the inner side portion of the clamping plate lies in the plane extending at acute angle to the first jaw plate.

A generally cylindrical elongate bar 29 is coupled to a second of the jaw plates adjacent the free ends of the arms of the second jaw plate. The bar has a longitudinal axis extending generally perpendicular to the arms of the second jaw plate.

In use, pivoting of the jaws towards one another moves the jaw plates toward each other such that the rod is moved towards a free edge of the outer side portion of the clamping plate located opposite the vertex spine of the clamping plate. The side plates of the clamping plate define a generally V-shaped channel designed for receiving therein a portion of an elongate object extended between the jaw plates generally perpendicular to the arms of the jaw plates. With reference to FIG. 2, in use, an object is placed on a flat support surface and the hand tool is positioned so that the object and the flat surface are positioned between the jaw plates. The clamping plate abuts the object so that the object is extended along the V-shaped channel. The bar abuts the lower face of the support surface. The jaws are pivoted together to clamp the object to the support surface and the locking mechanism is engaged to hold the jaws fixedly in the clamped position.

Optionally, the side portions of the clamping plate and the bar each may have a resiliently deformable outer layer such as a resiliently deformable rubber or plastic outer coating for protecting the external threads of a threaded object from damage when clamped between the jaw plates.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hand tool, comprising:

a pair of elongate jaws pivotally coupled together at a pivot joint, said elongate jaws each having a longitudinal axis;

each of said jaws having a jaw plate coupled thereto;

a generally V-shaped clamping plate being coupled to a first of said jaw plates mounted on a first of said jaws, wherein said clamping plate has a pair of side plate portions converging together to form a vertex spine therebetween, said clamping plate being coupled to said first jaw plate at said vertex spine of said clamping plate, said vertex spine extending substantially perpendicular to the longitudinal axis of said first jaw;

an elongate bar being coupled to a second of said jaw plates mounted on a second of said jaws, said elongate bar having a longitudinal axis extending substantially perpendicular to the longitudinal axis of said second jaw; and wherein a distance between said elongate bar and said pivot joint is greater than a distance between said vertex spine and said pivot joint such that said bar is outwardly offset from said vertex spine.

2. The hand tool of claim 1, wherein each of said jaw plates is generally U-shaped and has a pair of spaced apart generally straight arms and an arcuate middle portion connecting said arms of the respective jaw plate together, each of said jaws being coupled to the associated jaw plate at said middle portion of the associated jaw plate such that said arm portions of each jaw plate outwardly extend from the respective jaw.

3. The hand tool of claim 2 wherein each of said arms of each jaw plate has a free end opposite said middle portion of the respective jaw plate, said clamping plate being coupled to said first jaw plate at said free ends of said arms of said first jaw plate.

4. The hand tool of claim 1, wherein said side portions of said clamping plate includes an inner side portion and an outer side portion, said inner side portion of said clamping plate being extended in a direction having a vector extending towards said jaw coupled to said first jaw plate, said outer side portion of said clamping plate being extended in a direction having a vector extending outwardly away from said jaw coupled to said first jaw plate.

5. The hand tool of claim 4, wherein said side portions of said clamping plate lie in planes forming an angle less than 180 degrees therebetween.

6. The hand tool of claim 5, wherein said angle formed between said side portions of said clamping plate is about 90 degrees.

7. The hand tool of claim 4, wherein at least one of said side portions of said clamping plate lies in a plane extending at an acute angle to said first jaw plate.

8. The hand tool of claim 7, wherein said inner side portion of said clamping plate lies in the plane extending at acute angle to said first jaw plate.

9. The hand tool of claim 1, wherein said pair of jaws comprise a first jaw and a second jaw, said first jaw being substantially C-shaped.

10. A hand tool, comprising:

a pair of elongate jaws pivotally coupled together at a pivot point, said elongate jaws each having a longitudinal axis;

a pair of handles connected to said jaws to permit corresponding pivoting of said jaws with relative movement of said handles towards and apart from each other;

a locking mechanism for releasably holding said jaws in a fixed position with respect to one another, said locking mechanism having a release lever mounted to one of said handles whereby actuation of said release lever disengages said locking mechanism to release said jaws from said fixed position;

an adjustment mechanism for adjusting the spacing between said jaws, said adjustment mechanism having an adjustment screw rotatable mounted to one of said handles whereby rotation of said adjustment screw in a first direction decreases the spacing between said jaws and rotation of said adjustment screw in a second direction opposite said first direction increases the spacing between said jaws;

each of said jaws having a jaw plate coupled thereto;

each of said jaw plates being generally U-shaped and having a pair of spaced apart generally straight arms and an arcuate middle portion connecting said arms of the respective jaw plate together;

each of said jaws being coupled to the associated jaw plate at said middle portion of the associated jaw plate such that said arm portions of each jaw plate outwardly extend from the respective jaw;

each of said arms of each jaw plate having a free end opposite said middle portion of the respective jaw plate;

a generally V-shaped clamping plate being coupled to a first of said jaw plates mounted on a first of said jaws;

said clamping plate having a pair of substantially planar side portions converging together to form a vertex spine therebetween;

said vertex spine of said clamping plate being coupled to said free ends of said arms of said first jaw plate to couple said clamping plate to said first jaw plate, said vertex spine extending substantially perpendicular to the longitudinal axis of said first jaw;

said side portions of said clamping plate including an inner side portion and an outer side portion, said inner side portion of said clamping plate being extended in a direction having a vector extending towards said jaw coupled to said first jaw plate, said outer side portion of said clamping plate being extended in a direction having a vector extending outwardly away from said jaw coupled to said first jaw plate;

said side portions of said clamping plate lying in planes forming an angle less than 180 degrees therebetween;

wherein said angle formed between said side portions of said clamping plate is about 90 degrees;

at least one of said side portions of said clamping plate lying in a plane extending at an acute angle to said first jaw plate;

wherein said inner side portion of said clamping plate lies in the plane extending at acute angle to said first jaw plate;

a generally cylindrical elongate bar being coupled to a second of said jaw plates on a second of said jaws adjacent said free ends of said arms of said second jaw plate, said elongate bar having a longitudinal axis extending substantially perpendicular to the longitudinal axis of said second jaw;

wherein a distance between said elongate bar and said pivot joint is greater than a distance between said vertex spine and said pivot joint such that said bar is outwardly offset from said vertex spine;

said bar having a longitudinal axis extending generally perpendicular to said arms of said second jaw plate;

wherein pivoting of said jaws towards one another moves said jaw plates toward each other such that a rod is moved towards a free edge of said outer side portion of said clamping plate located opposite said vertex spine of said clamping plate;

said side plates of said clamping plate defining a generally V-shaped channel adapted for receiving therein a portion of an elongate object extended between said jaw plates generally perpendicular to said arms of said jaw plates; and wherein said pair of jaws comprise a first jaw and a second jaw, said first jaw being substantially C-shaped whereby said jaw plate of said first jaw is maintained at a distance from said jaw plate of said second jaw such that said distance between said jaw plate of said first jaw and said jaw plate of said second jaw is adapted for facilitating securing of an elongate object to a flat surface.

* * * * *